US007918209B2

(12) United States Patent
Fischetti et al.

(10) Patent No.: US 7,918,209 B2
(45) Date of Patent: Apr. 5, 2011

(54) COUPLING ARRANGEMENT FOR AN INJECTION VALVE AND INJECTION VALVE

(75) Inventors: Gianbattista Fischetti, Cascina (IT); Mauro Grandi, Leghorn (IT); Matteo Soriani, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 34 days.

(21) Appl. No.: 12/499,533

(22) Filed: Jul. 8, 2009

(65) Prior Publication Data

US 2010/0018502 A1 Jan. 28, 2010

(30) Foreign Application Priority Data

Jul. 24, 2008 (EP) ..... 08013369

(51) Int. Cl.
*F02M 61/14* (2006.01)

(52) U.S. Cl. ..... 123/470; 277/591

(58) Field of Classification Search ..... 123/470
See application file for complete search history.

(56) References Cited

U.S. PATENT DOCUMENTS

| | | | | |
|---|---|---|---|---|
| 3,841,277 | A * | 10/1974 | Schafer | 123/470 |
| 5,934,253 | A * | 8/1999 | Kojima et al. | 123/470 |
| 6,009,856 | A * | 1/2000 | Smith et al. | 123/470 |
| 6,178,950 | B1 * | 1/2001 | Stockner et al. | 123/470 |
| 6,263,863 | B1 * | 7/2001 | Giovannini et al. | 123/470 |
| 6,286,839 | B1 * | 9/2001 | Mitsui et al. | 277/603 |
| 6,578,554 | B2 * | 6/2003 | Schroeer | 123/470 |
| 6,615,802 | B2 * | 9/2003 | Reiter et al. | 123/470 |
| 6,807,945 | B2 * | 10/2004 | Reiter et al. | 123/470 |
| 6,840,226 | B2 * | 1/2005 | Hans | 123/470 |
| 6,848,425 | B2 * | 2/2005 | Raimann | 123/470 |
| 6,899,341 | B2 * | 5/2005 | Neumaier | 277/647 |
| 6,921,035 | B2 * | 7/2005 | Hohl | 239/585.1 |
| 6,953,162 | B2 * | 10/2005 | Hans | 239/585.1 |
| 7,195,003 | B2 * | 3/2007 | Liskow | 123/470 |
| 7,293,550 | B2 * | 11/2007 | Beardmore | 123/470 |
| 7,383,818 | B1 * | 6/2008 | Beardmore | 123/470 |

(Continued)

FOREIGN PATENT DOCUMENTS

DE 10108195 8/2002

(Continued)

OTHER PUBLICATIONS

European Search Report, EP08013369.7-1263, 5 pages, Oct. 2, 2008.

*Primary Examiner* — Thomas N Moulis
(74) *Attorney, Agent, or Firm* — King & Spalding L.L.P.

(57) ABSTRACT

A coupling arrangement for coupling an injection valve to a cylinder head of a combustion engine has a housing with a central longitudinal axis coupled to a fuel rail at a first axial end area and to a valve body at a second axial end area of the housing, and the valve body being arranged at the central longitudinal axis having at least one first protrusion arranged facing a second axial end area of a first ring element. Furthermore, the first ring element is arranged at least partly circumferentially the valve body at the first protrusion, wherein at a first axial end area of the first ring element the first ring element is in contact with the housing at the second axial end area and at the second axial end area the first ring element rests on the cylinder head. The first ring element has a plastic.

15 Claims, 4 Drawing Sheets

U.S. PATENT DOCUMENTS

| | | | | |
|---|---|---|---|---|
| 7,484,499 | B2 * | 2/2009 | Beardmore | 123/470 |
| 7,600,502 | B2 * | 10/2009 | Welzmueller et al. | 123/470 |
| 2003/0168533 | A1 | 9/2003 | Hans | |
| 2003/0168534 | A1 | 9/2003 | Hohl | |
| 2003/0183201 | A1 | 10/2003 | Hans | |

FOREIGN PATENT DOCUMENTS

| | | | |
|---|---|---|---|
| EP | 1255038 | | 9/2004 |
| WO | WO02/073025 | A1 | 9/2002 |
| WO | WO 02/073027 | A1 | 9/2002 |

* cited by examiner

COUPLING ARRANGEMENT FOR AN INJECTION VALVE AND INJECTION VALVE

CROSS-REFERENCE TO RELATED APPLICATIONS

This application claims priority to EP Patent Application No. 08013369 filed Jul. 24, 2008, the contents of which is incorporated herein by reference in its entirety.

TECHNICAL FIELD

The invention relates to a coupling arrangement for an injection valve and an injection valve for a combustion chamber of a combustion engine.

BACKGROUND

Injection valves are in widespread use, in particular for internal combustion engines where they may be arranged in order to dose fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter, and also various elements of the injection valve being responsible for the way the fluid is dosed may vary in a wide range. In addition to that, injection valves may accommodate an actuator for actuating a needle of the injection valve, which may, for example, be an electromagnetic actuator or a piezoelectric actuator.

In order to enhance the combustion process in view of the creation of unwanted emissions, the respective injection valve may be suited to dose fluids under very high pressures. The pressures may be in the case of a gasoline engine in the range of up to 200 bar and in the case of a diesel engine in the range of up to 2 000 bar, for example.

EP1255038B1 discloses a fuel injection system for the direct injection of fuel into at least one combustion space of an internal combustion engine. The fuel injection system has at least one fuel injection valve for each combustion space. The fuel injection valve can be inserted in each case at an injection portion into an assigned receiving board formed on a cylinder head of the internal combustion engine.

SUMMARY

According to various embodiments, a coupling arrangement for coupling an injector to a cylinder head can be created which is simply to be manufactured and which facilitates a proper flexible and precise assembly of the injector to the cylinder head and a reliable operation of the injection valve.

According to an embodiment, a coupling arrangement for coupling an injection valve to a cylinder head of a combustion engine, may comprise a housing of the injection valve having a central longitudinal axis, the housing being designed to be coupled to a fuel rail at a first axial end area of the housing and to a valve body at a second axial end area of the housing, the valve body being arranged at the central longitudinal axis comprising at least one first protrusion being arranged facing a second axial end area of a first ring element, and the first ring element being arranged at least partly circumferentially the valve body at the first protrusion of the valve body, wherein at a first axial end area of the first ring element the first ring element is in contact with the housing at the second axial end area of the housing and at the second axial end area of the first ring element the first ring element rests on the cylinder head, wherein the first ring element comprises a plastic.

According to a further embodiment, the first ring element may have a larger inner diameter at the first axial end area of the first ring element than at the second axial end area of the first ring element. According to a further embodiment, the first ring element may have a first ring element area of contact and the housing having a housing area of contact, the first ring element being in contact with the housing at the housing area of contact via the first ring element area of contact, wherein the housing area of contact is at least partly tapered and the first ring element comprises at least partly a tapered recess at the first ring element area of contact. According to a further embodiment, the coupling arrangement may comprise a second ring element being arranged circumferentially the valve body at the first protrusion of the valve body and the first ring element comprising an inner groove being designed and arranged to at least partly take in the second ring element. According to a further embodiment, the valve body may comprise a groove being designed and arranged to at least partly take in the first ring element and/or the second ring element. According to a further embodiment, the first ring element may comprise at least one second protrusion being arranged at the second axial end area of the first ring element and being designed and arranged at least partly in the groove of the valve body. According to a further embodiment, the second ring element may comprise a plastic. According to a further embodiment, the plastic of the second ring element may be rubber. According to a further embodiment, a cross section of the second ring element may be at least partly rectangular shaped.

According to another embodiment, an injection valve for a combustion chamber of a combustion engine may comprise such a coupling arrangement as described above.

BRIEF DESCRIPTION OF THE DRAWINGS

Various embodiments are explained in the following with the aid of schematic drawings. These are as follows.

Elements of the same design and function that appear in different illustrations are identified with same reference characters.

DETAILED DESCRIPTION

Figure 1:
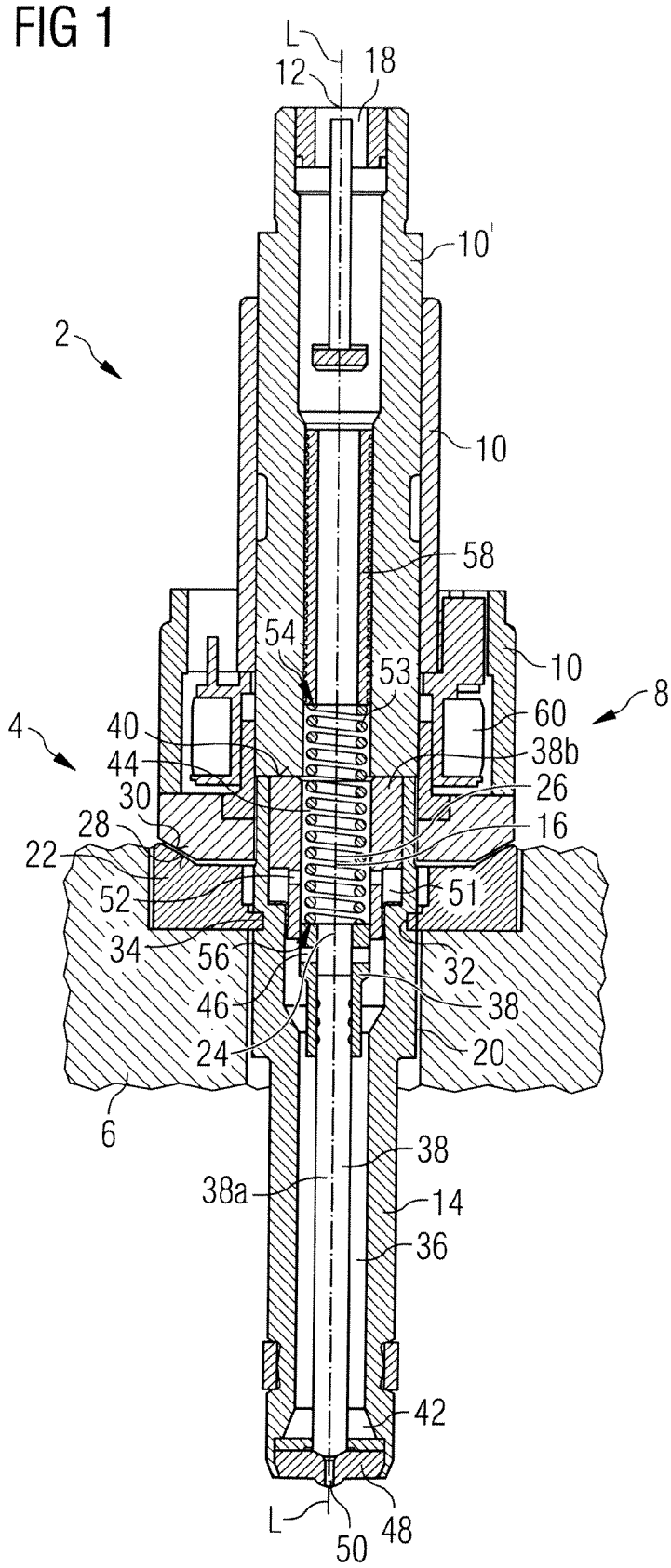
FIG. 1 an injection valve with a coupling arrangement in a longitudinal section view, FIG. 2 an exemplary embodiment of the coupling arrangement in a longitudinal section view, FIG. 3 a further exemplary embodiment of the coupling arrangement in a longitudinal section view, FIG. 4 a further exemplary embodiment of the coupling arrangement in a longitudinal section view, FIG. 5 a further exemplary embodiment of the coupling arrangement in a longitudinal section view, FIG. 6 an exemplary embodiment of a first ring element and a second ring element of the coupling arrangement, and FIG. 7 an exemplary embodiment of the first ring element of the coupling arrangement 4.

According to an embodiment, a coupling arrangement for coupling an injector to a cylinder head of a combustion engine. The coupling arrangement comprises a housing of the injector having a central longitudinal axis, the housing being designed to be coupled to a fuel rail at a first axial end area of the housing and to a valve body at a second axial end area of the housing, and the valve body being arranged at the central longitudinal axis comprising at least one first protrusion being arranged facing a second axial end area of a first ring element. Furthermore, the coupling arrangement comprises the first ring element being arranged at least partly circumferentially the valve body at the first protrusion of the valve body, wherein at a first axial end area of the first ring element the first ring element is in contact with the housing at the second axial end area of the housing and at the second axial end area of the first ring element the first ring element rests on the cylinder head. The first ring element comprises a plastic.

Thus, the coupling arrangement is simply to be manufactured and enables low production costs, for example compared to a coupling arrangement comprising a first ring element comprising stainless steel. The first ring element supports the placement of the injector to the cylinder head by being designed as a distance plate and the ring element allows an assembly of the injector to the cylinder head by allowing the injector to pivot between the cylinder head and the fuel rail during the assembly of the injector. Therefore, the coupling arrangement facilitates a proper flexible and precise assembly of the injector to the cylinder head. Furthermore, a wearing due to a metal to metal contact between the cylinder head and the injector can be avoided, since the first ring element comprises plastic. Moreover, no additional component such as a snap ring is necessary to maintain the first ring element in its position at the valve body. Thus, low production costs are enabled. Furthermore, a noise transmission within the injection valve can be limited and therewith a reliable operation of the injection valve is enabled due to the first ring element being one component without a metal to metal contact and comprising plastic. For example, the plastic of the first ring element comprises a thermoplastic polymer resin of the polyester family such as Polyethylene terephthalate (PET) or Polybutylene terephthalate (PBT).

Preferably, the first protrusion of the valve body is circular regarding the central longitudinal axis and the valve body extends into a combustion chamber of the combustion engine at an axial end area of the valve body facing away from the housing.

In an advantageous embodiment the first ring element has a larger inner diameter at the first axial end area of the first ring element than at the second axial end area of the first ring element.

Thus, an especially precise assembly of the first ring element to the housing and to the valve body is enabled. Therefore, an especially precise assembly of the injector to the cylinder head and a reliable operation of the injection valve are enabled. For example, the first ring element is molded.

In a further advantageous embodiment the first ring element has a first ring element area of contact and the housing has a housing area of contact. The first ring element is in contact with the housing at the housing area of contact via the first ring element area of contact, wherein the housing area of contact is at least partly tapered and the first ring element comprises at least partly a tapered recess at the first ring element area of contact.

Thus, an especially precise assembly of the first ring element to the housing is enabled. Therefore, an especially precise assembly of the injector to the cylinder head and a reliable operation of the injection valve are enabled.

In a further advantageous embodiment the coupling arrangement comprises a second ring element being arranged circumferentially the valve body at the first protrusion of the valve body and the first ring element comprises an inner groove being designed and arranged to at least partly take in the second ring element.

Thus, an especially precise assembly of the first ring element to the valve body via the second ring element is enabled. Therefore, an especially precise assembly of the injector to the cylinder head and a reliable operation of the injection valve are enabled. In particular, the second ring element is arranged between the valve body and the first ring element to retain the first ring element in its position regarding the valve body. Further, the second ring element can limit interference between the first ring element and the valve body. For example, a cross section of the second ring element is circular shaped. For example, the second ring element is an o-ring.

In a further advantageous embodiment the valve body comprises a groove being designed and arranged to at least partly take in the first ring element and/or the second ring element.

Thus, an especially precise assembly of the first ring element to the valve body and/or the first ring element to the valve body via the second ring element is enabled. Therefore, an especially precise assembly of the injector to the cylinder head and a reliable operation of the injection valve are enabled.

In a further advantageous embodiment the first ring element comprises at least one second protrusion being arranged at the second axial end area of the first ring element and being designed and arranged at least partly in the groove of the valve body.

Thus, an especially precise assembly of the first ring element to the valve body is enabled. Therefore, an especially precise assembly of the injector to the cylinder head and a reliable operation of the injection valve are enabled. For example, the second protrusion of the first ring element is circular regarding the central longitudinal axis. Alternatively, the second protrusion of the first ring element may be intermitted by recesses regarding the central longitudinal axis.

In a further advantageous embodiment the second ring element comprises a plastic.

Thus, the second ring element is simply to be manufactured and enables low production costs. Furthermore, an especially proper flexible assembly of the first ring element to the valve body via the second ring element and therewith of the injector to the cylinder head is enabled. For example, the plastic of the second ring element comprises a thermoplastic polymer resin of the polyester family such as Polyethylene terephthalate (PET) or Polybutylene terephthalate (PBT).

In a further advantageous embodiment the plastic of the second ring element is rubber.

Thus, the second ring element is simply to be manufactured and enables low production costs. Furthermore, an especially proper flexible assembly of the first ring element to the valve body via the second ring element is enabled. Therefore, a proper flexible and precise assembly of the injector to the cylinder head is enabled.

In a further advantageous embodiment a cross section of the second ring element is at least partly rectangular shaped.

Thus, a larger contact area of the second ring element with the valve body is enabled. Therefore, an especially reliable and precise assembly of the second ring element to the valve body and therewith of the first ring element to the valve body via the second ring element is enabled. For example, the second ring element may be shaped as a circlip.

According to another embodiment, an injection valve for a combustion chamber of a combustion engine comprising a coupling arrangement as describe above in the various embodiment.

An injection valve 2 (FIG. 1) may be used as a fuel injection valve for a combustion chamber of an internal combustion engine and comprises a coupling arrangement 4 for coupling the injection valve 2 to a cylinder head 6 of the combustion engine. Furthermore, the injection valve 2 comprises an actuator unit 8.

A housing 10 of the coupling arrangement 4 has a central longitudinal axis L and is designed to be coupled to a fuel rail at a first axial end area 12 of the housing 10 and to a valve body 14 at a second axial end area 16 of the housing 10. The fuel rail is designed to be connected to a high-pressure fuel chamber of the internal combustion engine, the fuel is stored under high pressure, for example, under the pressure of about 200 bar in the case of a gasoline engine or of about 2000 bar in the case of a diesel engine.

At the first axial end area 12 of the housing 10 the housing 10 comprises a fluid inlet portion 18. The valve body 14 of the coupling arrangement 4 is arranged at the central longitudinal axis L and comprises at least one first protrusion 20. A first ring element 22 is arranged at least partly circumferentially the valve body 14 at the first protrusion 20 of the valve body 14, wherein the first protrusion 20 of the valve body 14 faces a second axial end area 24 of the first ring element 22. At a first axial end area 26 of the first ring element 22 the first ring element 22 is in contact with the housing 10 at the second axial end area 16 of the housing 10 and at the second axial end area 24 of the first ring element 22 the first ring element 22 rests on the cylinder head 6.

The first ring element 22 comprises a plastic. For example, the plastic of the first ring element 22 comprises a thermoplastic polymer resin of the polyester family such as Polyethylene terephthalate (PET) or Polybutylene terephthalate (PBT). Thus, the coupling arrangement 4 is simply to be manufactured and enables low production costs. Preferably, the first ring element 22 has a larger inner diameter at the first axial end area 26 of the first ring element 22 than at the second axial end area 24 of the first ring element 22. Preferably, the first ring element 22 has a first ring element area of contact 28 and the housing 10 has a housing area of contact 30. For example, the first ring element 22 is in contact with the housing 10 at the housing area of contact 30 via the first ring element area of contact 28 with the housing area of contact 30 being at least partly tapered and the first ring element 22 comprises at least partly a tapered recess at the first ring element area of contact 28.

Preferably, the valve body 14 comprises a groove 32 being designed and arranged to at least partly take in the first ring element 22. For example, the first ring element 22 comprises at least one second protrusion 34 being arranged at the second axial end area 24 of the first ring element 22 and being designed and arranged at least partly in the groove 32 of the valve body 14.

The injection valve 2 comprises a cavity 36 which is axially led through the valve body 14. The injection valve 2 further comprises a valve needle 38 taken in the cavity 36 of the valve body 14. The valve needle 38 comprises an end section **38*a* and an armature 38*b*. Alternatively, the valve needle 38 may be made in one piece or the valve needle 38 may comprise further parts. The armature 38*b* is fixed to the end section 38*a* of the valve needle 38. Furthermore, the valve needle 38 has a front surface 40 turned away from a fluid outlet portion 42 of the cavity 36 and a recess 44 which is arranged in direction of the central longitudinal axis L from the front surface 40 over a portion of the axial length of the valve needle 38. The armature 38*b* has openings 46 which couple the recess 44 of the valve needle 38 and the cavity 36 of the valve body 14 hydraulically. The recess 44 of the valve needle 38, the openings 46 and the cavity 36 of the valve body 14 are parts of a main fluid line which allows a fluid flow from the fluid inlet portion 18 to the fluid outlet portion 42**.

On one of the free ends of the cavity 36 of the valve body 14 the fluid outlet portion 42 is formed which is closed or opened depending on the axial position of the valve needle 38. In a closing position of the valve needle 38 it rests sealingly on a seat 48 thereby preventing a fluid flow through at least one injection nozzle 50 in the valve body 14. The injection nozzle 50 may be for example an injection hole, but it may also be of some other type suitable for dosing fluid. The seat 48 may be made in one part with the valve body 14 or may also be a separate part from the valve body 14.

Between the valve body 14 and the valve needle 38 a chamber 51 is arranged which is coupled hydraulically with the recess 44 of the valve needle 38 by a channel 52. Preferably the chamber 51 is arranged axially symmetric relative to the central longitudinal axis L.

A spring 53 is arranged in the recess 44 of the valve needle 38 preferably to rest on a first spring rest 54 and a second spring rest 56 of the valve needle 38. By this the spring 53 is mechanically coupled to the valve needle 38. An adjusting tube 58 is provided in the recess 44 of the valve needle 38. The adjusting tube 58 comprises the first spring rest 54 for the spring 53 and may be moved axially during the manufacturing process of the injector in order to preload the spring 53 in a desired way.

The injection valve 2 is provided with a drive that is preferably an electromagnetic drive, comprising a coil 60, which is preferably extrusion-coated, the valve body 14, the armature **38*b* and a top part 10' of the housing 10 all forming an electromagnetic circuit. The armature 38*b* preferably has a large diameter compared to the diameter of the end section 38*a* of the valve needle 38. The large diameter enables a proper electromagnetic flow through the armature 38*b* which contributes to a proper controllability of the end section 38*a* of the valve needle 38**.

If the coil 60 is energized, this will result in an electromagnetic force acting on the valve needle 38. The electromagnetic force acts against the mechanical force obtained from the spring 53. By appropriately energizing the coil 60, the valve needle 38, in particular the end section **38*a* of the valve needle 38, may in that way be moved away from its closing position which results in a fluid flow through the injection nozzle 50. After a predetermined time the coil 60** may be de-energized again.

In the following the function of the injection valve 2 is described in detail:

The fluid may flow from the fluid inlet portion 18 through the top part 10' of the housing 10 and the adjusting tube 58 to the recess 44 of the valve needle 38. Through the openings 46 in the armature **38*b* of the valve needle 38 the fluid may flow to the cavity 36 of the valve body 14 and the fluid outlet portion 42. If the valve needle 38 allows a fluid flow through the fluid outlet portion 42 in an opening position the fluid may flow through the injection nozzle 50. If the valve needle 38 is moving upward from its closing to an opening position fluid may flow from the recess 44 of the valve needle 38 through the channel 52 to the chamber 51**.

Figure 2:
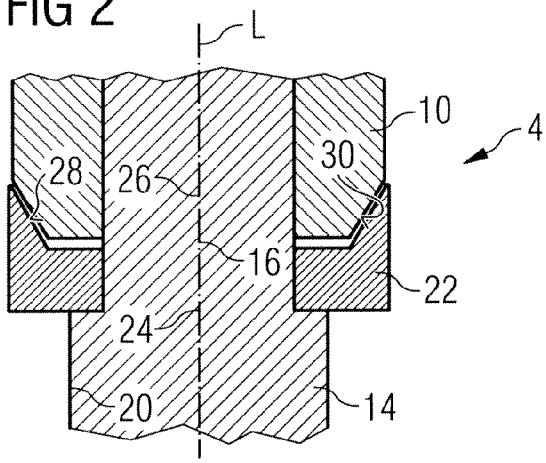

FIG. 2 shows an exemplary embodiment of the coupling arrangement 4 in a longitudinal section view. The coupling arrangement 4 comprises the housing 10 with the central longitudinal axis L, the valve body 14 and the first ring element 22. At the second axial end area 16 of the housing 10 the housing is coupled to the valve body 14. The valve body 14 is arranged at the central longitudinal axis L comprising the first protrusion 20 being arranged facing a second axial end area 24 of the first ring element 22. The first ring element 22 is arranged at least partly circumferentially the valve body 14 at the first protrusion 20 of the valve body 14. At the first axial end area 26 of the first ring element 22 the first ring element 22 is in contact with the housing 10 at the second axial end area 16 of the housing 10 and at the second axial end area 24 of the first ring element 22 the first ring element 22 rests on the cylinder head 6 (FIG. 1).

The first ring element 22 comprises plastic. Moreover, the first ring element 22 has a larger inner diameter at the first axial end area 26 of the first ring element 22 than at the second axial end area 24 of the first ring element 22. The first ring element 22 has a first ring element area of contact 28 and the housing 10 has a housing area of contact 30. For example, the first ring element 22 is in contact with the housing 10 at the housing area of contact 30 via the first ring element area of contact 28 with the housing area of contact 30 being at least partly tapered and the first ring element 22 comprises at least partly a tapered recess at the first ring element area of contact 28.

Figure 3:
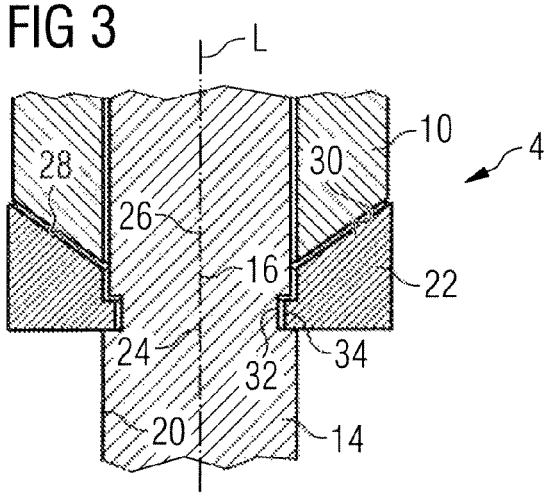

FIG. 3 shows a further exemplary embodiment of the coupling arrangement 4 in a longitudinal section view. The coupling arrangement 4 comprises the housing 10 with the central longitudinal axis L, the valve body 14 and the first ring element 22.

The valve body 14 comprises the groove 32 being designed and arranged to at least partly take in the first ring element 22. The first ring element 22 comprises the second protrusion 34 being arranged at the second axial end area 24 of the first ring element 22 and being designed and arranged at least partly in the groove 32 of the valve body 14.

Figure 4:
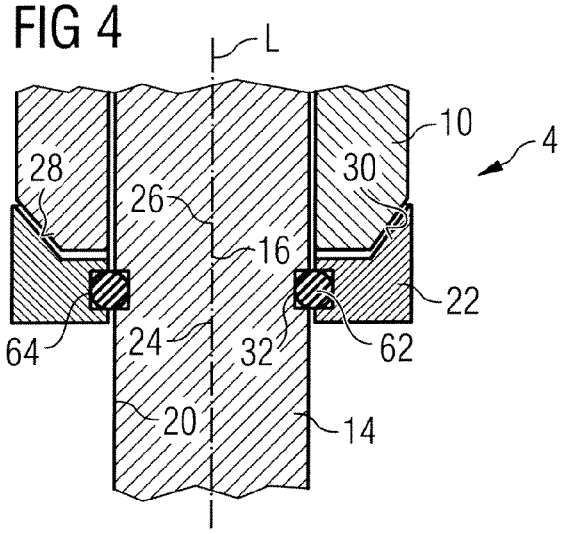

FIG. 4 shows a further exemplary embodiment of the coupling arrangement 4 in a longitudinal section view. The coupling arrangement 4 comprises the housing 10 with the central longitudinal axis L, the valve body 14, the first ring element 22 and a second ring element 62. The second ring element 62 is arranged circumferentially the valve body 14 at the first protrusion 20 of the valve body 14. The first ring element 22 comprises an inner groove 64 being designed and arranged to at least partly take in the second ring element 62. The valve body 14 comprises the groove 32 being designed and arranged to at least partly take in the second ring element 62. Preferably, the second ring element 62 comprises a plastic. Thus, the coupling arrangement is simply to be manufactured and enables low production costs. For example, the plastic of the second ring element 62 is rubber.

Figure 5:
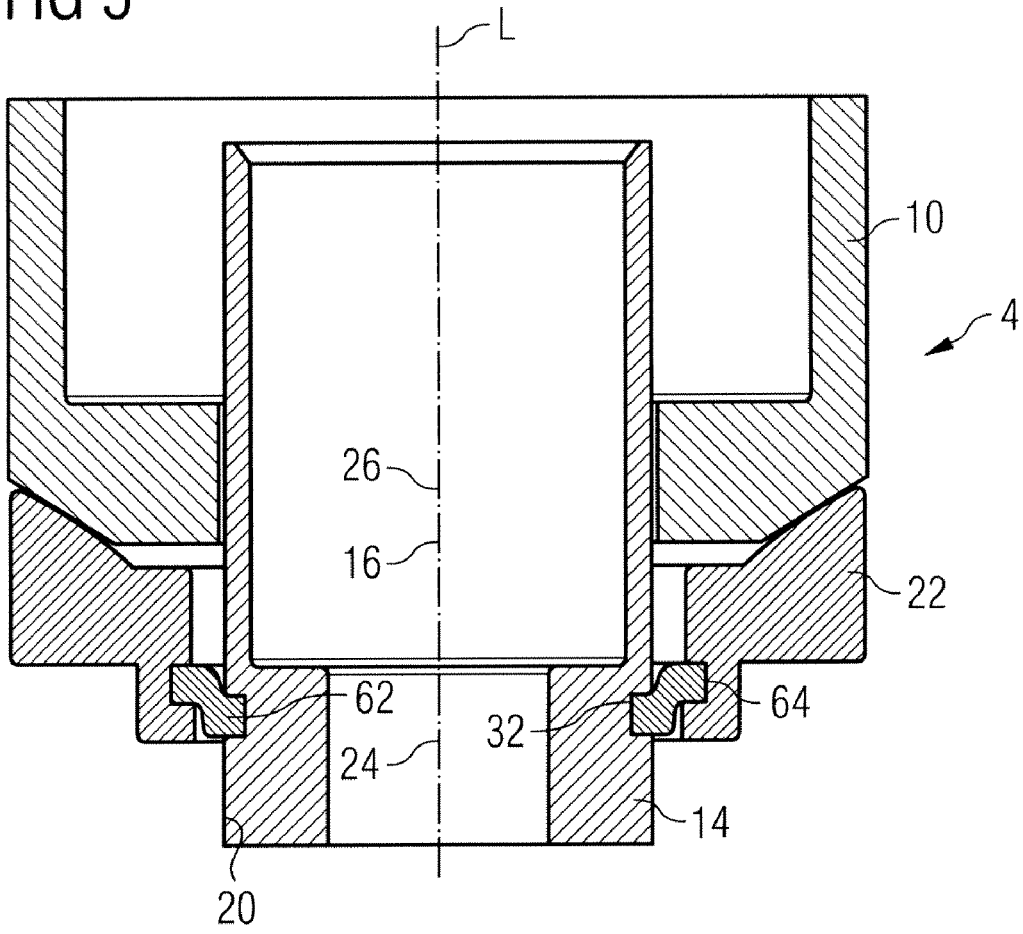

FIG. 5 shows a further exemplary embodiment of the coupling arrangement 4 in a longitudinal section view. The coupling arrangement 4 comprises the housing 10 with the central longitudinal axis L, the valve body 14, the first ring element 22 and the second ring element 62. The second ring element 62 is arranged circumferentially the valve body 14 at the first protrusion 20 of the valve body 14. The first ring element 22 comprises the inner groove 64 being designed and arranged to at least partly take in the second ring element 62. The valve body 14 comprises the groove 32 being designed and arranged to at least partly take in the second ring element 62. A cross section of the second ring element 62 is at least partly rectangular shaped. The second ring element 62 is on its first axial end facing away from the central longitudinal axis L arranged in the inner groove 64 of the first ring element 22 and on its second axial end facing away from the first axial end facing the central longitudinal axis L the second ring element 62 is arranged in the groove 32 of the valve body 14 being axially displaced to the inner groove 64 of the first ring element 22 regarding the central longitudinal axis L. Thus, a larger contact area of the second ring element 62 with the valve body 14 is enabled. Therefore, an especially reliable and precise assembly of the second ring element 62 to the valve body 14 and therewith of the first ring element 22 to the valve body 14 via the second ring element 62 is enabled. Furthermore, a contact between the first ring element 22 and the valve body 14 can be avoided.

Figure 6:
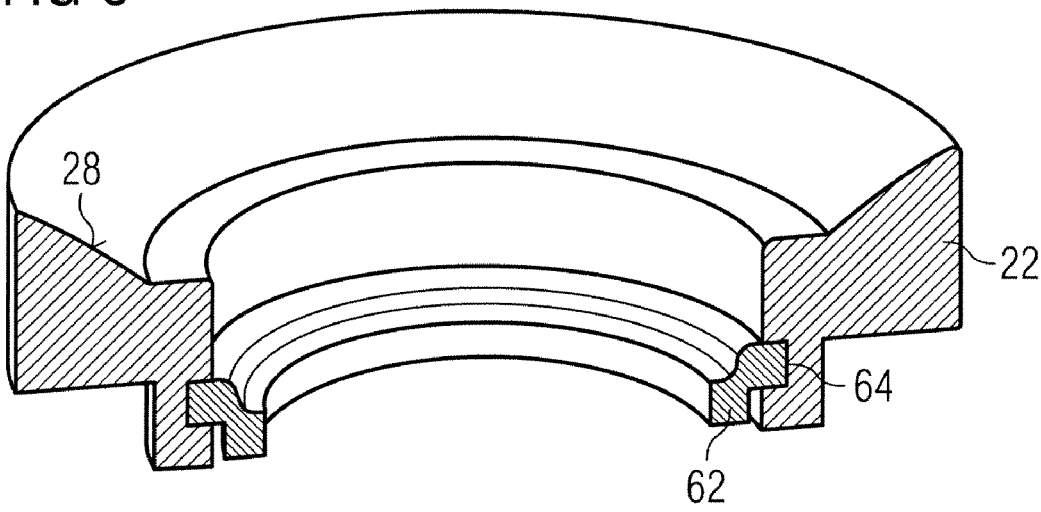

FIG. 6 shows an exemplary embodiment of the first ring element 22 and the second ring element 62 of the coupling arrangement 4. The first ring element 22 comprises the inner groove 64 being designed and arranged to at least partly take in the second ring element 62. For example, the first ring element 22 is in contact with the housing 10 via the first ring element area of contact 28, wherein the first ring element 22 comprises at least partly a tapered recess at the first ring element area of contact 28.

Figure 7:
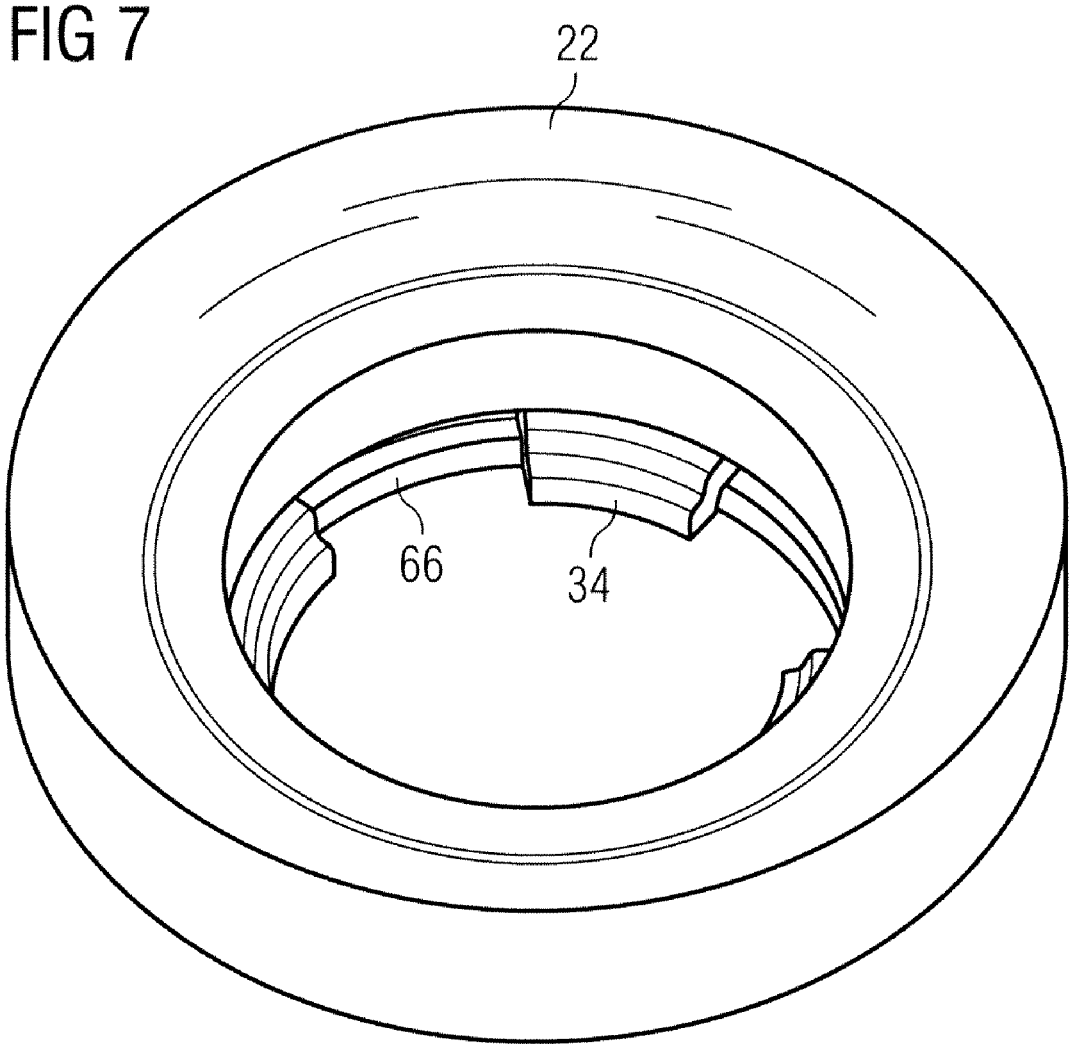

FIG. 7 shows an exemplary embodiment of the first ring element 22 of the coupling arrangement 4. The first ring element 22 comprises at least one second protrusion 34, for instance the second protrusion 34 is intermitted by recesses 66 of the second protrusion 34. For example, the first ring element 22 comprises four second protrusions 34 and four recesses 66 of the second protrusion 34.

The invention is not restricted by the explained embodiments. For example, the first ring element 22 and/or the second ring element 62 of the coupling arrangement 4 may comprise a different shape. Furthermore, the valve body 14 and/or the housing 10 of the coupling arrangement 4 may comprise a different shape.

What is claimed is:

1. A coupling arrangement for coupling an injection valve to a cylinder head of a combustion engine, the coupling arrangement comprising:

a housing of the injection valve having a central longitudinal axis, the housing being designed to be coupled to a fuel rail at a first axial end area of the housing and to a valve body at a second axial end area of the housing, a first ring element being arranged at least partly circumferentially around the valve body, wherein at a first axial end area of the first ring element the first ring element is in contact with the housing at the second axial end area of the housing and at the second axial end area of the first ring element the first ring element rests on the cylinder head, wherein the first ring element comprises a plastic, and a second ring element being arranged at least partly circumferentially around the valve body, wherein the second ring element is at least partially received within a circumferential groove formed in a surface of the first ring element.

2. The coupling arrangement according to claim 1, wherein the first ring element having a larger inner diameter at the first axial end area of the first ring element than at the second axial end area of the first ring element.

3. The coupling arrangement according to claim 1, wherein the first ring element having a first ring element area of contact and the housing having a housing area of contact, the first ring element being in contact with the housing at the housing area of contact via the first ring element area of contact, wherein the housing area of contact is at least partly tapered and the first ring element comprises at least partly a tapered recess at the first ring element area of contact.

4. The coupling arrangement according to claim 1, wherein the valve body comprising a groove being designed and arranged to at least partly take in at least one of the first ring element and the second ring element.

5. The coupling arrangement according to claim 1, wherein the second ring element comprising a plastic.

6. The coupling arrangement according to claim 1, wherein the plastic of the second ring element being rubber.

7. The coupling arrangement according to claim 1, wherein a cross section of the second ring element being at least partly rectangular shaped.

8. An injection valve for a combustion chamber of a combustion engine comprising a coupling arrangement comprising:

a housing of the injection valve having a central longitudinal axis, the housing being designed to be coupled to a fuel rail at a first axial end area of the housing and to a valve body at a second axial end area of the housing, a first ring element being arranged at least partly circumferentially around the valve body wherein at a first axial end area of the first ring element the first ring element is in contact with the housing at the second axial end area of the housing and at the second axial end area of the first ring element the first ring element rests on the cylinder head, and a second ring element being arranged at least partly circumferentially around the valve body, wherein the second ring element is at least partially received within a circumferential groove formed in a surface of the first ring element.

9. A coupling arrangement comprising:

a housing of an injection valve having a central longitudinal axis, wherein the housing can be coupled to a fuel rail at a first axial end area of the housing and to a valve body at a second axial end area of the housing, wherein the valve body is arranged at the central longitudinal axis, a first ring element being arranged at least partly circumferentially around the valve body, wherein at a first axial end area of the first ring element the first ring element is in contact with the housing at the second axial end area of the housing and at the second axial end area of the first ring element the first ring element can rest on a cylinder head, and a second ring element being arranged at least partly circumferentially around the valve body, wherein the second ring element is at least partially received within a circumferential groove formed in a surface of the first ring element.

10. The coupling arrangement according to claim 9, wherein the first ring element having a larger inner diameter at the first axial end area of the first ring element than at the second axial end area of the first ring element.

11. The coupling arrangement according to claim 9, wherein the first ring element having a first ring element area of contact and the housing having a housing area of contact, the first ring element being in contact with the housing at the housing area of contact via the first ring element area of contact, wherein the housing area of contact is at least partly tapered and the first ring element comprises at least partly a tapered recess at the first ring element area of contact.

12. The coupling arrangement according to claim 9, wherein the valve body comprising a groove being designed and arranged to at least partly take in at least one of the first ring element and the second ring element.

13. The coupling arrangement according to claim 9, wherein the second ring element comprising a plastic.

14. The coupling arrangement according to claim 9, wherein the plastic of the second ring element being rubber.

15. The coupling arrangement according to claim 9, wherein a cross section of the second ring element being at least partly rectangular shaped.

* * * * *